United States Patent [19]

Romer et al.

[11] Patent Number: 4,619,202

[45] Date of Patent: Oct. 28, 1986

[54] MULTIPLE PURPOSE AMMUNITION

[75] Inventors: Rudolf Romer, Kaarst; Michael Schwenzer, Duesseldorf; Reinhard Synofzik, Juechen, all of Fed. Rep. of Germany

[73] Assignee: Rheinmetall GmbH, Duesseldorf, Fed. Rep. of Germany

[21] Appl. No.: 682,206

[22] Filed: Dec. 17, 1984

Related U.S. Application Data

[63] Continuation-in-part of Ser. No. 561,545, Dec. 14, 1983, abandoned.

[30] Foreign Application Priority Data

Dec. 14, 1982 [DE] Fed. Rep. of Germany ..... 3246173

[51] Int. Cl.[4] ..... F42B 5/16

[52] U.S. Cl. ..... 102/443; 102/470; 102/472

[58] Field of Search ..... 102/430, 443, 483, 469–472, 102/490, 505, 530, 531, 202.5, 202.6, 202.7, 202.8, 202.9, 202.13

[56] References Cited

U.S. PATENT DOCUMENTS

| | | | |
|---|---|---|---|
| 2,055,506 | 9/1936 | Schlumberger | 102/504 X |
| 2,141,827 | 12/1938 | Schlumberger | 189/1 C |
| 2,884,859 | 5/1959 | Alexander et al. | 102/439 X |
| 3,177,809 | 4/1965 | French | 102/430 X |
| 3,283,719 | 11/1966 | Grandy | 102/434 |
| 3,773,353 | 11/1973 | Trowbridge | 102/443 |
| 4,363,272 | 12/1982 | Simmons | 102/202.9 |

*Primary Examiner*—Harold J. Tudor

[57] ABSTRACT

A multi-range ammunition unit for firing at a high angle and with preselected muzzle velocities. The ammunition unit includes at least two partial propellant charges, a first one of which is fixedly mounted to the bottom of the shell casing and the second one or ones of which are fixedly mounted to the bottom of the projectile of the ammunition unit. All partial propellant charges are coaxially arranged with respect to the shell casing. Mechanical and/or electrical ignition means are provided to first ignite the first propellant charge and then selectively sequentially ignite the second propellant charge or charges.

14 Claims, 6 Drawing Figures

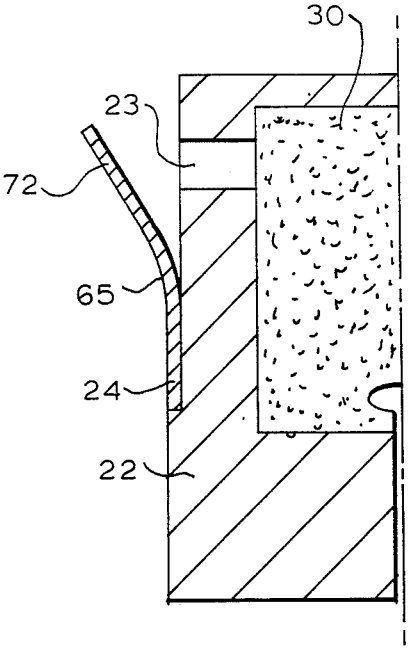
FIG. 3
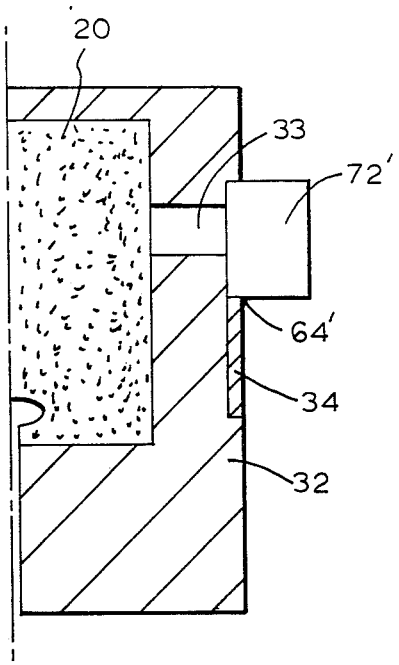
FIG. 4
FIG. 5
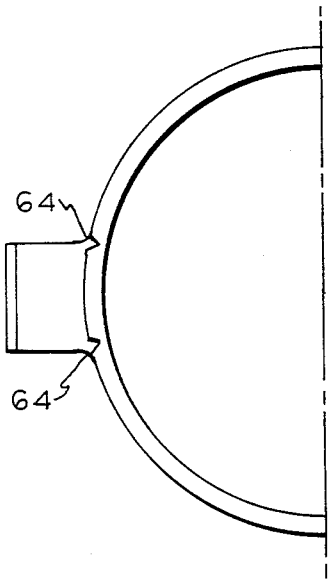
FIG. 6
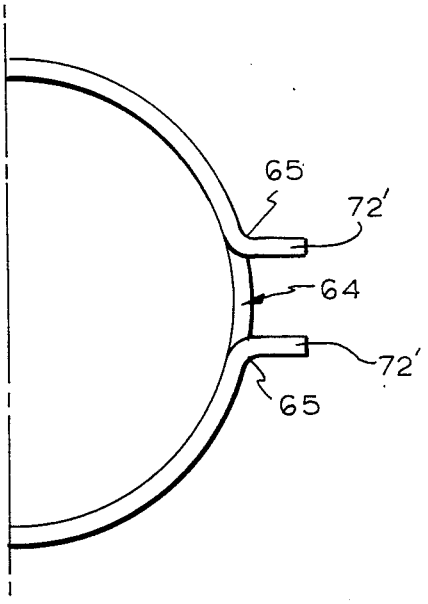

MULTIPLE PURPOSE AMMUNITION

CROSS-REFERENCE TO RELATED APPLICATIONS

This application is a continuation-in-part application of our copending application Ser. No. 561,545, filed Dec. 14, 1983, now abandoned for AMMUNITION IN PARTICULAR FOR HIGH OR STEEP ANGLE FIRE. This application also relates to copending and co-assigned application Ser. No. 448,508, filed Dec. 9, 1982.

BACKGROUND OF THE INVENTION

This invention relates to multi-purpose ammunition, and in particular to ammunition having a multiple range capability. Such type of ammunition is disclosed in U.S. Pat. No. 3,283,719 to Andrew J. Grandy. Such type of ammunition is also disclosed in our copending application Ser. No. 561,545, filed Dec. 14, 1983. In U.S. Pat. No. 3,283,719 there is disclosed a type of ammunition which can have multi-range capability which is at least partially independent from the requirement of increasing the gun barrel length. There are provided in the Grandy-type ammunition for this purpose at the rear end of the casing different types of propellant charges. These propellant charges are arranged parallel and adjacent to each other within a propellant chamber which has a wall that surrounds all of the propellant charges. These propellant charges are either singly or jointly ignitable by means fo separate primers.

The Grandy-type ammunition makes it possible to arrange the partial propellant charges eccentrically with respect to the ammunition axis as can be noted from FIGS. 6 and 7 of U.S. Pat. No. 3,283,719. This eccentric arrangement causes a streaming-out of the partial propellant charge gases eccentrically with respect to the ammunition axis. This constitutes an important inner ballistic drawback which may even damage the wing and/or fin-stabilization guiding means for the ammunition. This type of multi-purpose ammunition has therefore been found unsatisfactory.

Another drawback of the Grandy-type ammunition resides in that all of the propellant charges are fastened to the ammunition casing, so that when, utilizing only one propellant charge at least another propellant charge remains live and in a mechanically ignitable condition in the casing, whereby, for example, the personnel servicing the ammunition are exposed to seriour danger.

In view of the fact that each partial propellant charge must be separately ignited by individual separate firing pins via a corresponding igniting arrangement, the Grandy-type ammunition cannot be used in high cadence-firing machine cannons, because of the complex firing bolt construction and control. Consequently, due to the separate igniting of the corresponding partial propellant charge, an application of this type of ammunition in a machine cannon is furthermore not possible, because the propellant charge can generally only be ignited by means of one firing pin in a machine cannon.

A further drawback of this known type of ammunition resides in that the propellant charge casing for each propellant charge must be closed at its front end by a sealing disc so that, when one partial propellant charge is ignited, its gas production does not also ignite one of the other partial propellant charges. Such discs may remain in the ammunition casing while separating therefrom, or may remain in the gun barrel, so that under certain circumstances they can cause considerable disturbances in the firing cycle.

SUMMARY OF THE INVENTION

It is an object of this invention to provide cartridge ammunition of the afore-described type, which has a multi-range capability that is partially independent from the firing angle. This novel type of ammunition is fired by means of single or jointly ignitable partial propellant charges without inhibiting the inner ballistics and without having semi-live partial propellant charges remaining in the cartridge casing. This novel type of ammunition is capable of being fired at high cadence from a machine cannon and eliminates any remnants of the propellant charge containers in the gun barrel in order not to inhibit the high firing cadence capability of the weapon. By securing only one partial propellant charge to the casing bottom and all additional partial propellant charges to the projectile bottom in a rotational-symmetrical relationship with respect to the ammunition axis, a more favorable ballistic relationship results. The partial propellant charge which is secured to the casing bottom is the first or the sole partial propellant charge which is ignited. The arrangement provides, for the purpose of achieving different firing ranges, a uniform force transfer onto the projectile without inner ballistic drawbacks and utilizes, for example, only a single partial propellant charge, without the danger of an unintentional ignition of the remaining partial propellant charges. These remaining propellant charges are then transported jointly with the projectile into the target region and therefore no danger to the personnel servicing this type of ammunition can occur.

The partial propellant charges which are mounted on the projectile proper can, in an advantage manner, be at least partially arranged in front or laterally with respect to a rearwardly mounted partial propellant charge. In this way, the corresponding volumes of the partial propellant charges can be sized in accordance with predetermined velocity steps for the projectile and specifically the volume of the partial propellant charge which is secured to the projectiler bottom can be substantially increased. Thus, the arrangement of partial propellant charges, one in front of the other, permits furthermore the mutual coordination of individual volumes of differently graduated partial propellant charge containers, whereby in a simple manner different graduated velocities are attainable.

According to a further feature of the invention it is possible, depending on the attainable firing distance, to ignite the first and selectively the additional partial propellant charges via a single ignition arrangement, whereby in a further advantageous manner an application of this cartridged ammunition in a conventional machine cannon is possible. By incorporating an electronic element within the ignition arrangement it is possible to achieve a simple voltage-dependent or frequency-dependent adjustable ignition by sequentially igniting in a predetermined manner the partial propellant charges mounted on the projectile.

According to a further advantageous feature of the invention the housings for the partial propellant charges have an outlet opening which is covered with a deformable sealing element of predetermined shape. While a region of this sealing element deforms during firing, such region does not separate from the remainder of the sealing element, whereby remnants of such sealing elements do not remain in the gun barrel and disruptions and disturbances in the firing cycle are avoided.

BRIEF DESCRIPTION OF THE DRAWING

With these and other objects in view, which will become apparent in the following detailed description, the present invention, which is shown by example only, will be clearly understood in connection with the accompanying drawing, in which:

FIG. 3 is a cross-sectional view of a container for a partial propellant charge which has a sealing element with a plurality of break zones for severing portions of the sealing element;

FIG. 4 is a cross-sectional view similar to FIG. 3 illustrating an alternative embodiment of such a container for a partial propellant charge;

FIG. 5 is a plan view of the partial propellant charge container of FIG. 3; and

FIG. 6 is a plan view of the partial propellant charge container of FIG. 4.

DETAILED DESCRIPTION

Figure 1:
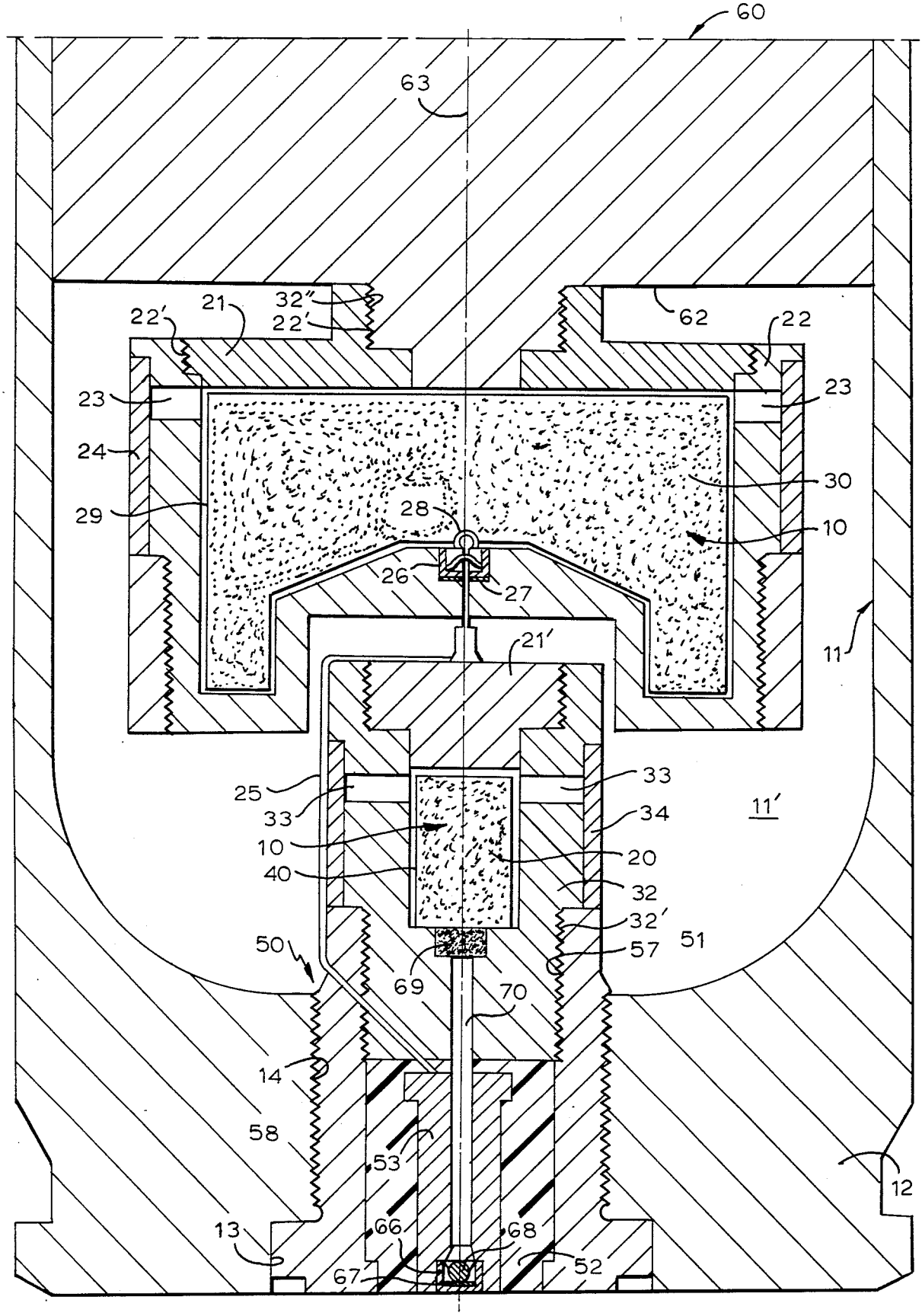
FIG. 1 is a longitudinal partial axial cross-sectional view of the rear portion of an ammunition unit incorporating the partial propellant charge arrangement of this invention in which one partial propellant charge is secured to the rear region of the propellant charge casing and another partial charge is secured to the projectile, which partial propellant charges are differently mechanically and electrically ignitable.

In the arrangement of FIG. 1 a casing 11 is provided with a bottom 12 which casing and bottom jointly define an inner chamber 11' holding a propellant charge 10 which consists of several partial propellant charges 20, 30. A housing 51 is threadably mounted in an axial bore 13 having an internal threaded portion 14. This housing 51 forms part of an ignition arrangement 50. The housing 51 is provided with an external threaded portion 58 which is threadably mounted within the internal portion 14 of the axial bore 13. This housing 51 surrounds an insulating tube 52 which is coaxially mounted in the housing 51 and which in turn surrounds a contact pin 53. This contact pin 53 is formed by means of a metallic conducting tube and includes at its lower external end an ignition cap 66 which is suitable for an electric or mechanical ignition. The housing 51 has an internal threaded bore 57 in which in turn a housing 32 for a partial propellant charge 20 is coaxially threadably mounted in the housing 51 by means of an external threaded portion 32'. The projectile 60 has a rearwardly extending axial projection having an external threaded portion 32" on which a sealing collar 21 is threadably coaxially mounted. This sealing collar forms part of a housing 22 for a further partial propellant charge 30 which is mounted on the sealing collar 21 by means of an internal thread 22'. The housing 22 is constructed in such a way that the partial propellant charge 30 is arranged in front of the housing 51, mounted on the bottom 12, in front of the partial propellant charge 20 and rotationally—symmetrically arranged with respect to the ammunition axis 63. The housing 22 also laterally surrounds the housing 51. The partial propellant charge 30 is encased in a charge capsule 29 and the partial propellant charge 20 is encased in a charge capsule 40. An electrical wire or cable 25 connects electrically the contact pin 53 with the ignition pill 28 for the ignition of the partial propellant charge 30. In the immediate vicinity of the ignition pill 28 there is provided a sealing plate 27 and an insulating capsule 26. The housing 22 has, for communicating the charge capsule 29 with the inner chamber 11', at least two outlet openings 23 which are radially arranged with respect to the ammunition axis 63. In a similar manner the housing 32 includes at least two throughbores 33 for communicating the charge capsule 40 with the inner chamber 11', which throughbores 33 are radially arranged with respect to the ammunition axis 63. The outlet openings 23 and 33 are hermetically sealed by means of sealing sleeves 24, 34 in the direction of the corresponding partial propellant charges 20, 30. An ignition channel 70 serves to place in communication the ignition cap 66 with the tablet-like supplemental charge 69 through which the ignition gases are conducted for igniting the partial propellant charge 20. The receiving chamber of the partial propellant charges 20 within the housing 32 is provided with a closing cap 21' threadably mounted in a receiving bore of the housing 32.

MANNER OF OPERATION

There now follows a description of the operation of the ammunition unit described herein-above in which description there is assumed that only the first propellant charge 20 is ignited.

A firing pin (not illustrated) is actuated by means of an electrical voltage of an ignition arrangement of a machine cannon (also not illustrated). This ignition is initiated in case a mechanical propellant charge igniter 68 fails to ignite by way of a non-applied voltage via the ignition cap 66 of the anvil 67 of the mechanical propellant charge igniter 68 which is partially built into the contact pin 53. The ignition smoke of the ignition cap travels to the supplemental charge 69 and the first partial propellant charge 20 is ignited. Via the pressure of the ignited partial propellant charge 20 the sleeve-like sealing element 34 opens in the region of the outlet openings 33 in a manner to be described in conjunction with the FIGS. 3 to 6. As a result of the pressure which builds up within the inner chamber 11' the sleeve-like sealing element 24 serves in a manner to protect the partial propellant charge 30. The projectile 60 now leaves the gun barrel with a muzzle velocity corresponding to the propellant charge 20 carrying with it a non-ignited partial propellant charge 30.

Figure 2:
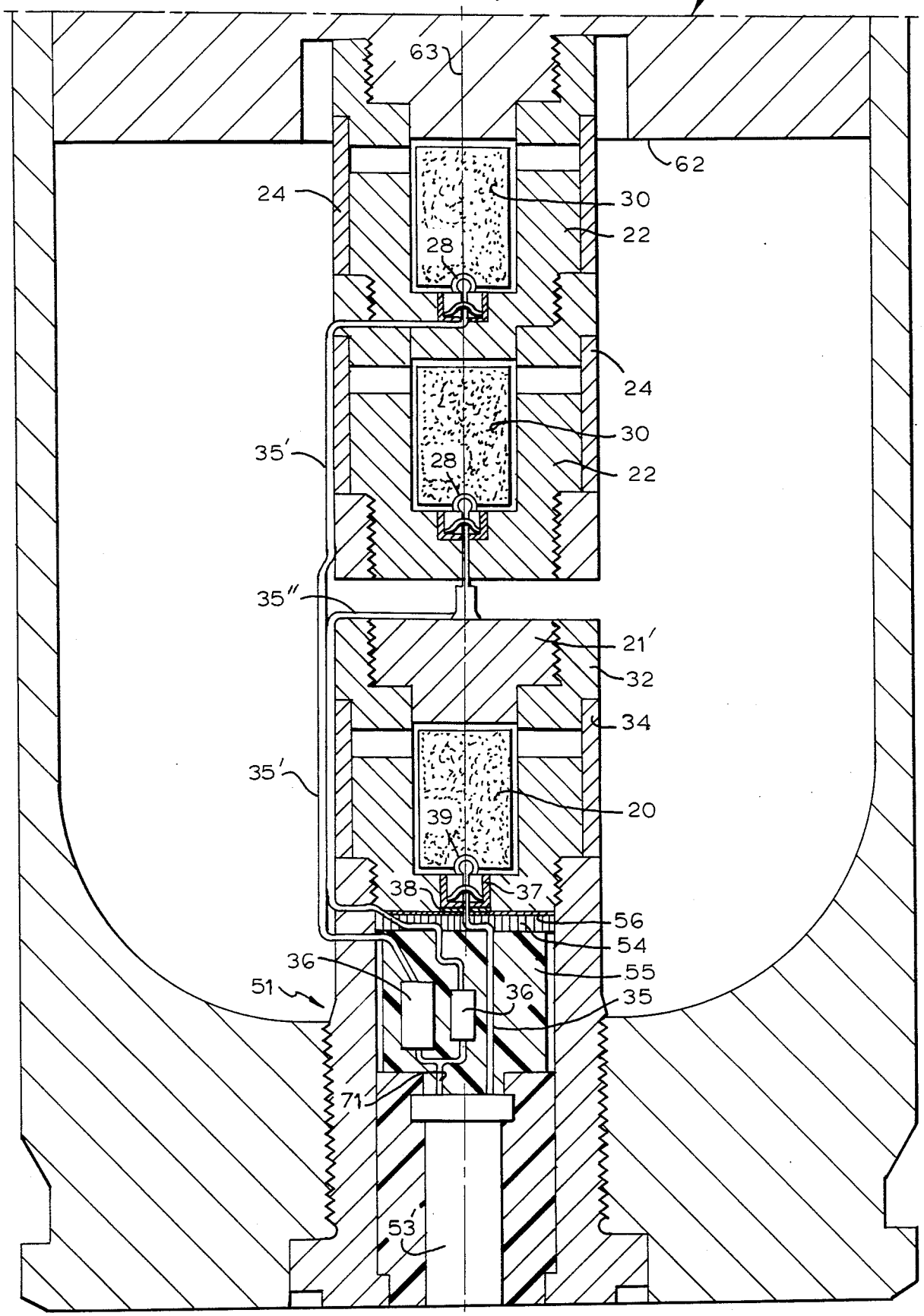
FIG. 2 is a longitudinal partial axial cross-section of the rear portion of an ammunition unit forming a second embodiment of this invention, wherein in the rear region of the cartridge casing a partial propellant charge is mounted on the cartridge casing bottom and two partial propellant charge charges are mounted on the projectile bottom, which later charges are electrically ignitable.

There is illustrated in FIG. 2 an alternate embodiment of the arrangement of the invention in which several electrical ignition means are disclosed. The ignition means for the partial propellant charge 20 mounted on the bottom 12 of the casing 11 is disclosed and illustrated. Two partial propellant charges 30 are mounted on the projectile proper in this embodiment. In contradistinction to the embodiment of FIG. 1, an ignition cable 35 connects the contact pin 53' with an ignition pill 39 for the propellant charge 20 mounted on the casing bottom 12. In the immediate vicinity of the ignition pill 39 there is arranged a sealing plate 38 and an insulating capsule 37. The space of the housing 51 disposed between ignition pill 39 and the contact pin 53' is substantially filled by means of a cast mass 55 which extends up to a grating 54 on which the separating plate 56 is mounted. In the cast mass 55 a number of electronic element 36 are disposed for purposes of coacting with corresponding partial propellant charges 30. These propellant charges 30 are mounted on the projectile bottom 62 via corresponding housings 22 and are arranged symmetrically with respect to the ammunition axis 63 in front of the rear-most housing 51. There are illustrated in FIG. 2 two partial propellant charges 30 which are fixedly secured to the projectile in front of the partial propellant charge 20. Accordingly, two electronic elements 36 are mounted in the cast mass 55. Both electronic elements 36 are electrically connected to each other by means of a common electric cable connection 71, which electrically connects them to the contact pin 53'. An electronic element 36 is connected with the ignition pill 28 of the propellant charge 30 via an electric connection 35'. The charge 30 is mounted directly on the projectile bottom 62, whereas the other electronic element 36 is connected to the ignition pill 28 of the next lower-most partial propellant charge 30 via a second electric connection cable 35''.

The electronic elements 36 can be constructed as diodes, whereby the partial propellant charges 30 can be sequentially ignited in a predetermined manner in dependence with the predetermined voltage that is applied via the firing pin of the weapon. Thereby it is possible to ignite, singly or jointly with the lower or, when sufficiently high voltage is applied, both of the upper partial propellant charges 30, which are secured to the projectile bottom 60.

The electronic elements 36 can also be constructed as frequency filters, whereby any random propellant charge 30, which is mounted on the projectile bottom, either directly or indirectly, can be ignited by means of a predetermined frequency or the propellant charges 30 can be ignited by means of frequency oscillations in a random multiple. Such electronic elements 36 may, in accordance with a non-illustrated embodiment, also be mounted in the housing 51 of a mechanically ignitable partial propellant charge 20, which propellant charge is mounted on the casing bottom 12. Thereby it is possible, when more than two partial propellant charges 30 are mounted on the projectile bottom 62 to ignite the second and each following partial propellant charge 30 via a corresponding electronic element 36 in a predetermined sequence or randomly selectively.

The electronic elements 36 permit a simple ignition in dependence with the applied voltage or frequency of all the partial propellant charges 30 which are mounted, directly or indirectly, on the projectile bottom 62, whereby an optimum adaptation of the muzzle velocity to the prevailing conditions is achievable. Advantageously no manipulation of the ammunition is necessary for selecting the muzzle velocity. And such selection can, moreover, be made when the ammunition unit is already mounted in a non-illustrated loading chamber and the breech has been closed.

FIGS. 3 to 6 illustrate two possible alternate embodiments which demonstrate in which manner the simple, tube-like sealing element 24, 34 of the housing 22, 32 is released in the region of the outlet openings 23, 33 when the corresponding partial propellant charges 20, 30 are ignited. As has been explained herein-above, the releases caused by the internal pressure formed at ignition and the opening of portions of the sealings 24, 34 do not destruct the entire sealing sleeves despite an unblocking of the outlet openings 23, 33. The sealing element (sleeve) 24, 34 includes in the region of the outlet openings 23, 33 at least one breaking zone 64 which extends axially. Thereby there is achieved that at least one bending edge 65 is formed which permits the outward bending or folding of the upper edge 72. FIGS. 3 and 5 illustrate an embodiment having two breaking zones 64 which rupture under the pressure of the propellant charge explosion and which bent about the horizontal bending edge 65 to form a predetermined and preshaped flap 72. In the embodiment of FIGS. 4 and 6 the rupturing of two flaps 72' by means of vertical breaking zones 64 and a horizontal breaking zone 64' is illustrated, whereby these flaps 72' deform in a predetermined way under the pressure of the propellant charge explosive gases about the vertical bending edges 65.

Although a limited number of embodiments of the invention have been illustrated in the accompanying drawings and described in the foregoing specification, it is to be especially understood that various changes, such as in the relative dimensions of the parts, materials used, and the like, as well as the suggested manner of use of the apparatus of the invention, may be made therein without departing from the spirit and scope of the invention, as will now be apparent to those skilled in the art.

We claim:

1. An improved multi-range ammunition unit for firing at a high angle and preselected exit muzzle velocity in which a plurality of partial propellant charges and the projectile are mounted in a shell casing and said partial propellant charges are jointly or separately ignited for obtaining different ranges, and wherein at least one first propellant charge is fixedly mounted on the bottom of the shell casing, the improvement comprising (a) at least one second propellant charge is fixedly connected to the bottom of said projectile and is disposed at least partially in front of said first propellant charge in said shell casing; and (b) means operatively connected to said first and second propellant charges for selectively first, and singly igniting said first propellant charge or jointly ignite said first propellant charge with at least one of said second propellant charges.

2. The improvement in a multi-range ammunition unit for firing at a high angle and preselected muzzle exit velocity as set forth in claim 1, wherein said first partial propellant charge which is fixedly centrally and axially mounted on said shell casing bottom, and said second partial propellant charges are also axially centrally mounted on the projectile bottom, said ignition means being either mechanically or electrically actuated.

3. The improvement in a multi-range ammunition unit for firing at a high angle and preselected muzzle exit velocity as set forth in claim 2, wherein said partial propellant charge is mounted in a first housing which is coaxially fixedly secured to the bottom of the shell casing, and said ignition means which operate electrically include a predetermined number of electric elements mounted in said first housing, each one of said electronic elements being electrically operatively connected to one of said second partial propellant charges and being selectively actuated by said ignition means.

4. The improvement in a multi-range ammunition unit for firing at a high angle and preselected muzzle exit velocity as set forth in claim 2, wherein said partial propellant charge is mounted in a first housing which is coaxially fixedly secured to the bottom of the shell casing, said ignition means which operate mechanically to ignite said first partial propellant charge is electrically operatively connected to one second partial propellant charge.

5. The improvement in a multi-range ammunition unit for firing at a high angle and preselected muzzle exit velocity as set forth in claim 2, wherein said partial propellant charge is mounted in a first housing which is coaxially fixedly secured to the bottom of the shell casing, said ignition means which operate mechanically to ignite said first partial propellant charge includes a predetermined number of electronic elements each one of which is electrically operatively connected to one of said second partial propellant charges and selectively sequentially ignites them via a corresponding electronic element.

6. The improvement in a multi-range ammunition unit for firing at a high angle and preselected muzzle exit velocity as set forth in claim 3, wherein said electronic elements are diodes which are sequentially actuated in dependence of the voltage applied by said ignition means so as to sequentially ignite said second partial propellant charges.

7. The improvement in a multi-range ammunition unit for firing at a high angle and preselected muzzle exit velocity as set forth in claim 5, wherein said electronic elements are diodes which are sequentially actuated in dependence of the voltage applied by said ignition means so as to sequentially ignite said second partial propellant charges.

8. The improvement in a multi-range ammunition unit for firing at a high angle and preselected muzzle exit velocity as set forth in claim 3, wherein said electronic elements are frequency filters, each one of said frequency filters being electronically operatively connected to one of said second partial propellant charges, so that when said ignition means applies a current of preselected frequency a preselected second partial propellant charge is ignited via the corresponding frequency filter.

9. The improvement in a multi-range ammunition unit for firing at a high angle and preselected muzzle exit velocity as set forth in claim 3, wherein said electronic elements are frequency filters, each one of said frequency filters being electronically operatively connected to one of said second partial propellant charges, so that when said ignition means applies a current of predetermined oscillation a preselected second partial propellant charge is ignited via the corresponding frequency filter.

10. The improvement in a multi-range ammunition unit for firing at a high angle and preselected muzzle exit velocity as set forth in claim 5, wherein said electronic elements are frequency filters, each one of said frequency filters being electronically operatively connected to one of said second partial propellant charges, so that when said ignition means applies a current of preselected frequency a preselected second partial propellant charge is ignited via the corresponding frequency filter.

11. The improvement in a multi-range ammunition unit for firing at a high angle and preselected muzzle exit velocity as set forth in claim 5, wherein said electronic elements are frequency filters, each one of said frequency filters being electronically operatively connected to one of said second partial propellant charges, so that when said ignition means applies a current of predetermined oscillation a preselected second partial propellant charge is ignited via the corresponding frequency filter.

12. The improvement in a multi-range ammunition unit for firing at a high angle and preselected muzzle exit velocity as set forth in claim 2, wherein (a) each of said first and second propellant charges is mounted in a corresponding first and second housing;

(b) each of said first and second housings has at least two outlet openings which extend transversely to the ammunition axis, said outlet openings being closed by a sleeve which is coaxially mounted on each housing; and (c) each sleeve is firmly mounted on the corresponding housing and the region of each sleeve which confront the corresponding outlet opening is deformable in such a way that the outlet opening is opened by the internal pressure caused by the explosive gases upon ignition of the corresponding partial propellant charge, and the deformed region of the sleeve remains attached to the sleeve after the deformation.

13. The improvement in a multi-range ammunition unit for firing at a high angle and preselected muzzle exit velocity as set forth in claim 12, wherein each sleeve has at least one breaking zone in the region which confronts a corresponding outlet opening, which breaking zone extends parallel to the axis of the corresponding housing and forms a bending edge upon breaking.

14. The improvement in a multi-range ammunition unit for firing at a high angle and preselected muzzle exit velocity as set forth in claim 12, wherein each sleeve has at least one breaking zone in the region which confronts a corresponding outlet opening, which breaking zone extends circumferentially relative to the axis of the corresponding housing and forms a bending edge upon breaking.

* * * * *